US008016608B2

(12) United States Patent
Amidon

(10) Patent No.: US 8,016,608 B2
(45) Date of Patent: Sep. 13, 2011

(54) PULL THROUGH MODULAR JACK

(75) Inventor: Jeremy Amidon, Marcellus, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 0 days.

(21) Appl. No.: 12/968,227

(22) Filed: Dec. 14, 2010

(65) Prior Publication Data

US 2011/0086538 A1 Apr. 14, 2011

Related U.S. Application Data

(62) Division of application No. 12/391,608, filed on Feb. 24, 2009, now Pat. No. 7,878,841.

(51) Int. Cl.
*H01R 11/20* (2006.01)

(52) U.S. Cl. ..... 439/418; 439/405; 439/409

(58) Field of Classification Search ..... 439/404–434
See application file for complete search history.

(56) References Cited

U.S. PATENT DOCUMENTS

| | | | | |
|---|---|---|---|---|
| 4,202,593 | A | | 5/1980 | Abernathy et al. |
| 4,606,595 | A | | 8/1986 | Dola |
| 4,648,678 | A | | 3/1987 | Archer |
| 4,921,436 | A | | 5/1990 | Sole et al. |
| 5,118,310 | A | | 6/1992 | Stroede et al. |
| 5,228,872 | A | | 7/1993 | Liu |
| 5,338,221 | A | | 8/1994 | Bowen et al. |
| 5,403,200 | A | | 4/1995 | Chen |
| 5,501,617 | A | | 3/1996 | Arnett |
| 5,624,274 | A | | 4/1997 | Lin |
| 5,626,490 | A | | 5/1997 | Pitts et al. |
| 5,762,518 | A | | 6/1998 | Tanigawa et al. |
| 5,885,111 | A | | 3/1999 | Yu |
| 5,899,770 | A | | 5/1999 | Ezawa |
| 5,971,792 | A | * | 10/1999 | Lin ..... 439/404 |
| 5,980,303 | A | | 11/1999 | Lee |
| 6,010,353 | A | * | 1/2000 | Ensz et al. ..... 439/404 |
| 6,077,122 | A | * | 6/2000 | Elkhatib et al. ..... 439/607.05 |
| 6,102,730 | A | * | 8/2000 | Kjeldahl et al. ..... 439/405 |
| 6,105,229 | A | | 8/2000 | Sullivan |
| 6,109,943 | A | | 8/2000 | Arnett |

(Continued)

FOREIGN PATENT DOCUMENTS

JP 2004319207 11/2004

(Continued)

OTHER PUBLICATIONS

PCT/US2010/025128, International Filing Date Feb. 24, 2010. International Search Report and Written Opinion. Date of Mailing: Oct. 13, 2010. 9 pages.

*Primary Examiner* — Truc T Nguyen
(74) *Attorney, Agent, or Firm* — Schmeiser, Olsen & Watts, LLP

(57) ABSTRACT

The present invention relates to a pull-through modular jack and method of use thereof. The modular jack allows wires to be fed through the housing and pulled tight prior to terminating. This ensures that the wires terminate with the insulation displacement contact very close to the point at which the wires are still twisted. Termination is made by moving a pressing portion to a pressed position, which then pushes the wires into the insulation displacement contacts that displace the wire insulation to make contact.

9 Claims, 15 Drawing Sheets

U.S. PATENT DOCUMENTS

| | | | | |
|---|---|---|---|---|
| 6,116,952 | A | 9/2000 | Nakata | |
| 6,213,816 | B1 * | 4/2001 | Meichsner et al. | 439/699.2 |
| 6,250,951 | B1 | 6/2001 | Milner et al. | |
| 6,254,421 | B1 * | 7/2001 | Denovich et al. | 439/409 |
| 6,338,643 | B1 | 1/2002 | Miller et al. | |
| 6,364,680 | B1 | 4/2002 | Liu et al. | |
| 6,402,561 | B1 | 6/2002 | Chen | |
| 6,416,349 | B1 | 7/2002 | Lee | |
| 6,435,898 | B2 | 8/2002 | Sahlberg et al. | |
| 6,506,072 | B2 * | 1/2003 | Nimura | 439/405 |
| 6,561,838 | B1 | 5/2003 | Blichfeldt | |
| 6,749,456 | B1 | 6/2004 | Conner et al. | |
| 6,769,937 | B1 | 8/2004 | Roberts | |
| 6,780,063 | B2 | 8/2004 | Wang et al. | |
| 6,830,488 | B2 | 12/2004 | Bush et al. | |
| 6,890,210 | B2 | 5/2005 | Lee | |
| 6,932,641 | B1 | 8/2005 | Liao | |
| 7,052,307 | B2 | 5/2006 | Kim et al. | |
| 7,083,472 | B2 | 8/2006 | Gordon et al. | |
| 7,097,513 | B2 | 8/2006 | Bryan | |
| 7,118,405 | B2 | 10/2006 | Peng | |
| 7,241,162 | B1 | 7/2007 | Lawrence | |
| 7,249,961 | B1 | 7/2007 | Provenzano | |
| 7,381,083 | B2 | 6/2008 | Amidon | |
| 7,540,760 | B1 | 6/2009 | Chen | |
| 7,878,841 | B2 * | 2/2011 | Amidon | 439/418 |
| 2006/0246784 | A1 | 11/2006 | Aekins et al. | |
| 2010/0227497 | A1 | 9/2010 | Amidon | |

FOREIGN PATENT DOCUMENTS

| | | |
|---|---|---|
| JP | 2006228458 | 8/2006 |

* cited by examiner

PULL THROUGH MODULAR JACK

CROSS-REFERENCE TO RELATED APPLICATIONS

This application is a divisional application claiming priority to U.S. application Ser. No. 12/391,608 filed on Feb. 24, 2009, entitled "Pull through modular jack and method of use thereof."

BACKGROUND OF INVENTION

1. Technical Field

The present invention relates generally to electrical connectors. In particular the invention relates to a pull through modular jack and method of use thereof.

2. Related Art

Modular jacks are widely used in telecommunication systems for facilitating connection of electrical communication components. Ease of installation and consistent termination of internal insulated wires of a communications cable are two important features of a modular jack. Ordinary jacks are designed to orient untwisted wires of a cable for termination with corresponding wire contact terminals according to common communication standards. Standard jack designs involve termination of the untwisted wires with contacts at a terminal location spaced away from where the wires are still bundled and twisted. Wire termination in ordinary jacks is often tedious because each wire must be individually aligned and positioned for termination. Moreover wire termination in common jacks can be faulty because the wires are not precisely located for termination with the jack during cable installation and because wires are often loosely oriented during installation instead of being firmly positioned into a proper termination location. In addition, movement of a cable, once installed, can cause strain that may dislodge the wires from proper termination with ordinary jack terminal contacts. Some known jacks also require use of special tools in order to consistently terminate the wires during installation of the cable to the jack. Accordingly a need exists for an improved modular jack and related method of use.

SUMMARY OF THE INVENTION

A first aspect of the present invention provides an electrical connector jack comprising: an electrical connector jack comprising: a housing, having a plug socket opening; at least one conductive terminal, located within the housing, the conductive terminal having a first contact portion and a second contact portion, wherein the second contact portion extends into the socket; a wire conduit, having a first end opening through the housing and a second end opening through the housing, the wire conduit configured to receive at least one insulated wire, wherein the first contact portion of the at least one conductive terminal extends into the conduit, and wherein the received insulated wire enters through the first end opening and is extendable out of the housing through the second end opening, so that the wire may be pulled tightly into location within the conduit; and a wire pressing portion, having a first non-pressed position and a second pressed position, wherein when the wire pressing portion is in the second pressed position the wire pressing portion acts upon an insulated wire received by the wire conduit and terminates the wire into electrical connection with the first contact portion of a corresponding at least one conductive terminal.

A second aspect of the present invention provides a modular jack comprising: a housing portion, having a plug socket; a first conduit having a first conduit opening, wherein the first conduit opening is configured to receive at least one insulated wire; a second conduit having a second conduit opening, wherein the second conduit opening is configured to permit extension of the at least one insulated wire out of the housing after the at least one insulated wire has been extended through the first conduit opening, so that the at least one insulated wire may be pulled tightly into position within the second conduit; at least one insulation displacement contact located between the first conduit opening and the second conduit opening, wherein the at least one insulation displacement contact is in electrical connection with a corresponding at least one conductive finger; and a pressing portion movably connected to the housing, wherein the pressing portion is configured to move to a pressed position to terminate and hold the at least one insulated wire in electrical connection with a corresponding at least one insulated displacement contact.

A third aspect of the present invention provides an electrical connector jack comprising: a housing, having a plug socket; a cavity within the housing, the cavity in physical communication with a first feed opening for receiving at least one conducting wire and a second feed opening through which a received at least one conducting wire protrudes beyond the exterior of the housing; at least one conductive terminal, having a wire contact portion and a finger portion, wherein the wire contact portion is located within the cavity; and a movable slug having a pressed position, wherein at least one conducting wire, when received, is terminated and held in electrical connection with the wire contact portion of a corresponding at least one conductive terminal when the slug is in the pressed position.

A fourth aspect of the present invention provides an electrical connector jack, comprising: a main body, having a plug socket; at least one conductive terminal within the main body, the conductive terminal having a wire contact portion and a finger portion; a pressing body movably connected to the main body; a first conduit bounded by the pressing body when connected to the main body, the first conduit having an opening for receiving a cable; a second conduit connected to the first conduit, wherein the second conduit is bounded by the connected pressing body and the main body, the second conduit configured to receive at least one insulated wire, and including an end through which a received at least one inner insulated wire protrudes from the housing, wherein the wire contact portion of the at least one conductive terminal is within the second conduit; and wherein the movable pressing body terminates and holds the at least one inner insulated wire in electrical connection with the first contact portion of a corresponding at least on conductive terminal when connected to the main body in a pressed position.

A fifth aspect of the present invention provides a method for assembling an electrical connector jack, the method comprising: providing a housing, having a plug socket; providing at least one conductive terminal within the housing, the conductive terminal having a first contact portion and a second contact portion; providing a conduit having a first end opening and a second end opening, wherein the first contact portion of the at least one conductive terminal is within the conduit; providing a wire pressing portion, the wire pressing portion being movable with respect to the housing; feeding at least one insulated wire into the first end opening of the conduit and out of the second end opening of the conduit, so that the at least one insulated wire extends out of the housing; pulling tight at least one insulated wire within the conduit after it extends out of the housing; and moving the wire pressing portion until the tightened at least one insulated wire within the conduit is terminated and held in electrical contact with the first contact portion of a corresponding at least one conductive terminal.

A sixth aspect of the present invention provides an electrical connector jack comprising: a housing, having a plug socket; at least one conductive terminal within the housing, the conductive terminal having a first contact portion and a second contact portion; a conduit, having a first end opening, for receiving at least one insulated wire and a second end opening, through which a received at least one insulated wire protrudes beyond the housing, wherein the first contact portion of the at least one conductive terminal is within the conduit; and movable means for terminating and securing the received at least one insulated wire in electrical connection with the first contact portion.

DETAILED DESCRIPTION OF THE INVENTION

Figure 1:
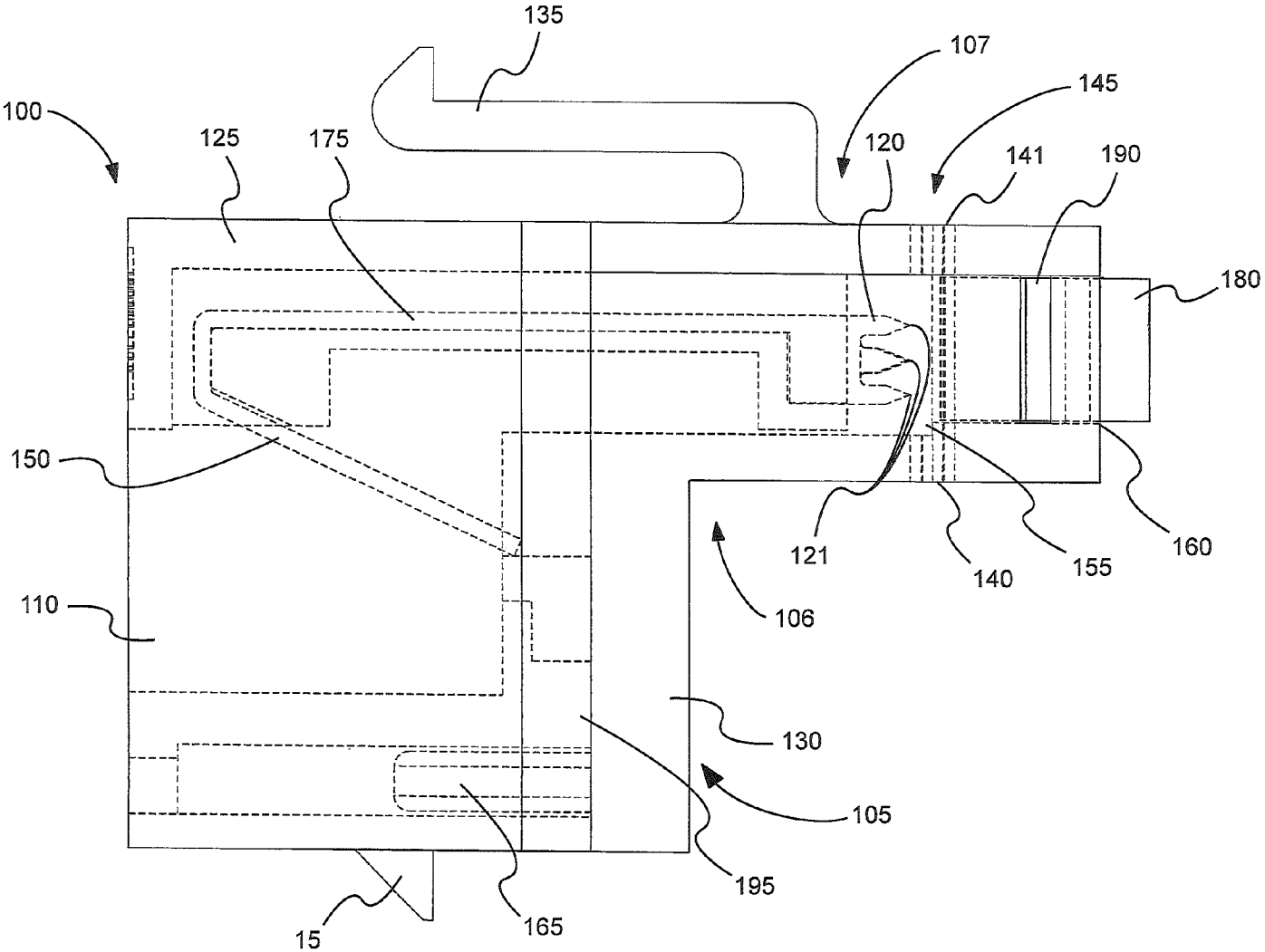
FIG. 1 shows a side view cutaway showing a modular electrical connector jack according to one embodiment of the present invention.
Figure 2:
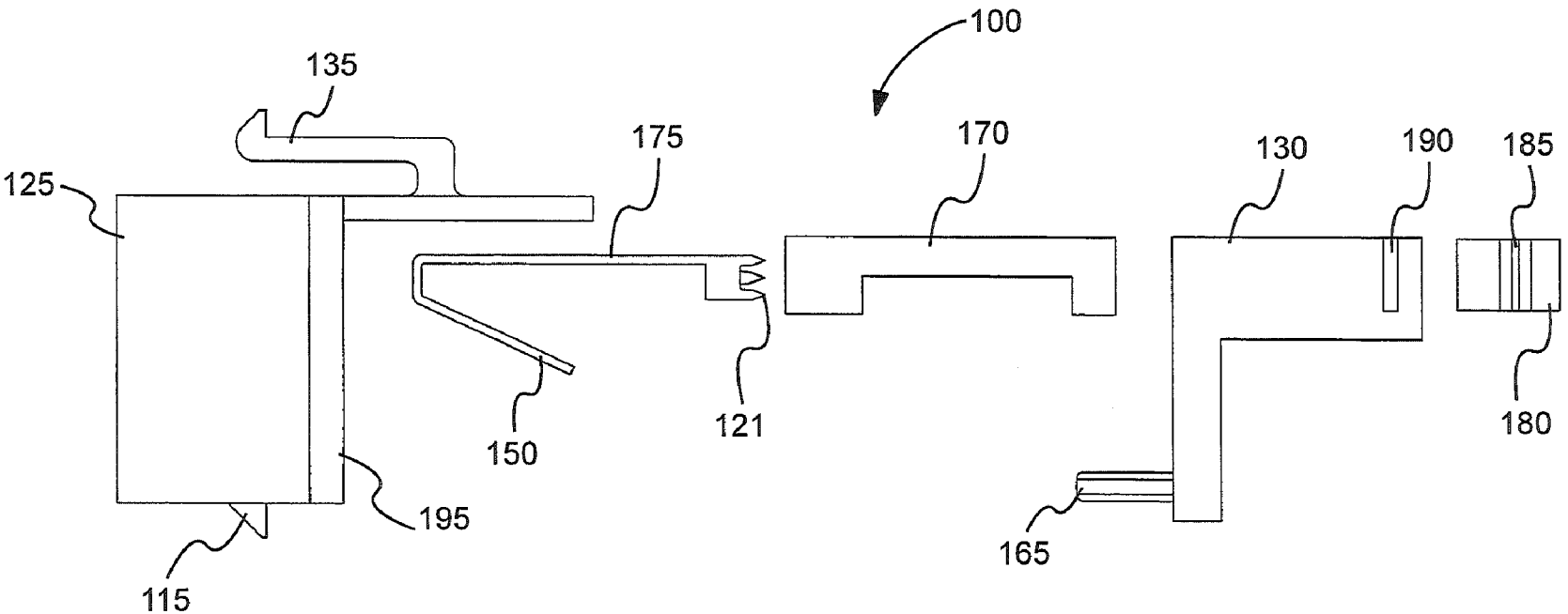
FIG. 2 shows a side view of a modular electrical connector jack prior to assembly according to one embodiment of the present invention.
Figure 3:
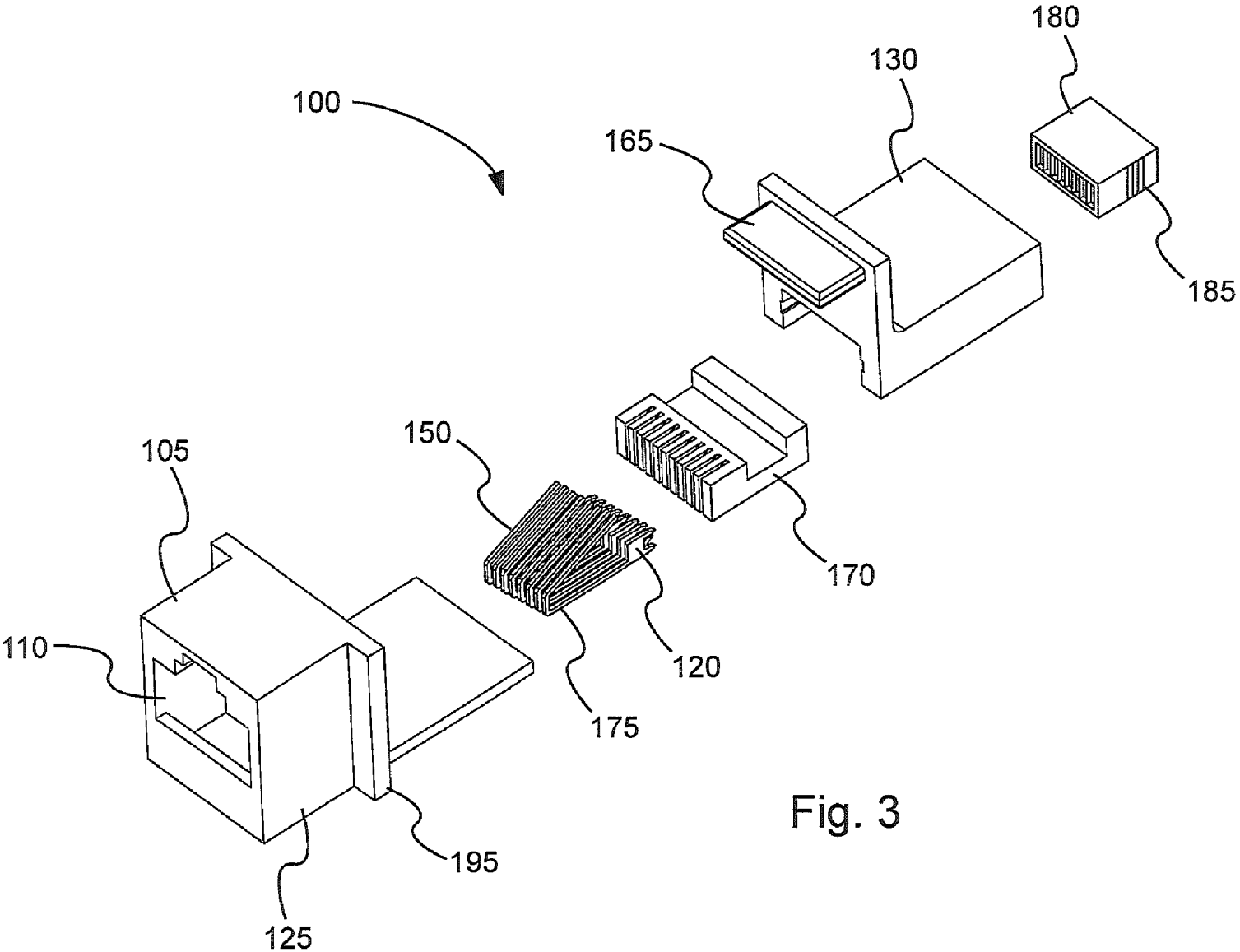
FIG. 3 shows a perspective view of a modular electrical connector jack prior to assembly according to one embodiment of the present invention.
Figure 4:
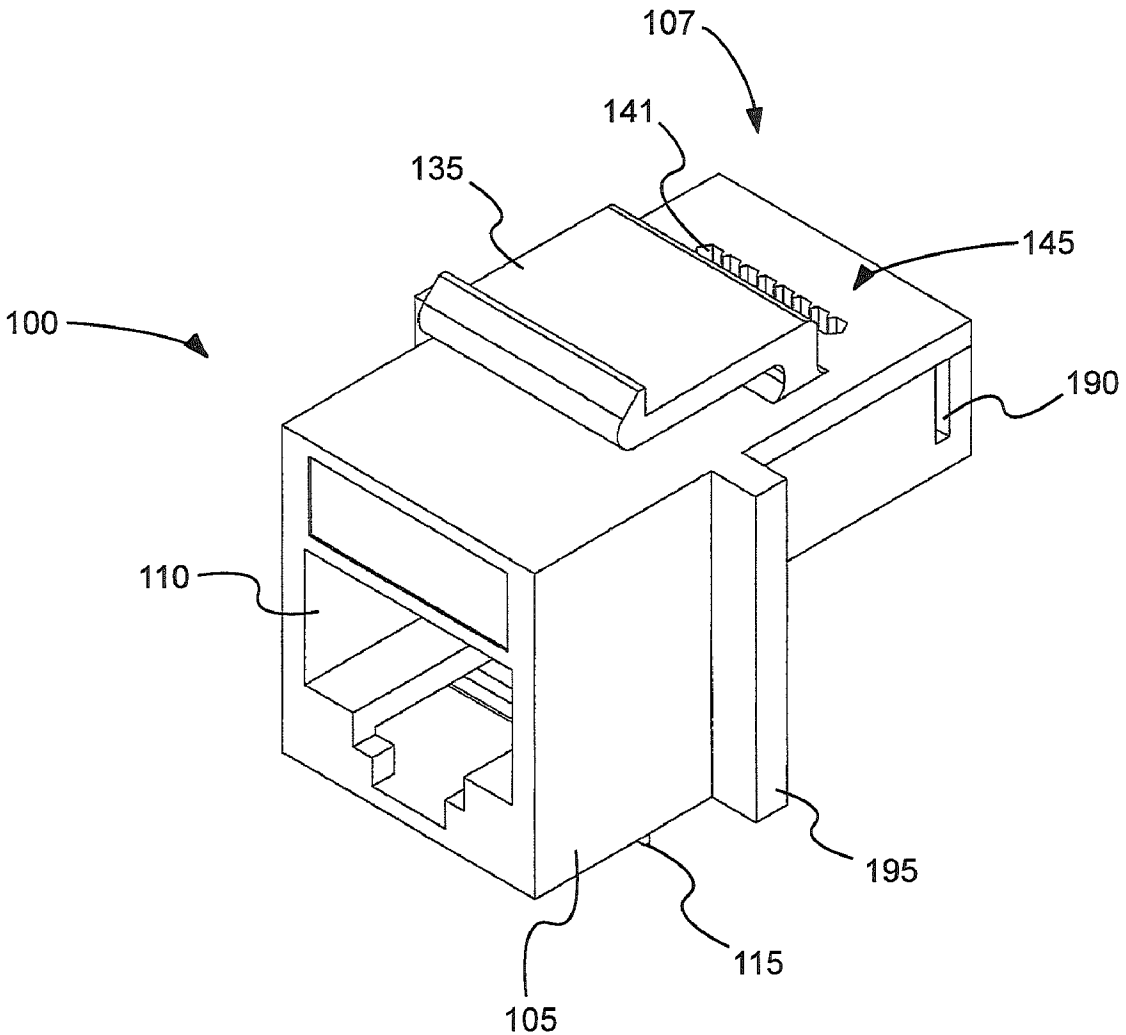
FIG. 4 shows a perspective view of an assembled modular electrical connector jack according to one embodiment of the present invention.
Figure 5:
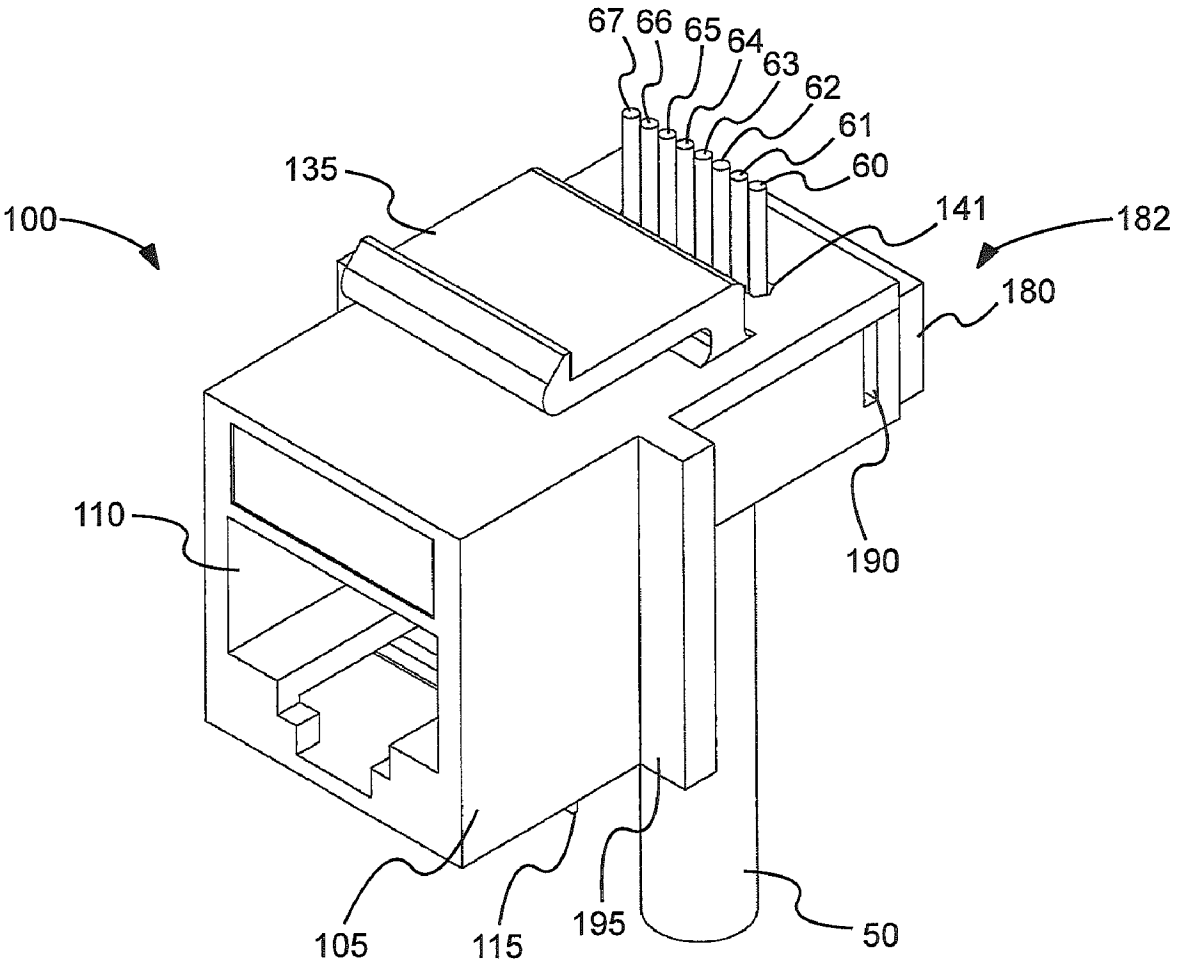
FIG. 5 shows a perspective view of an assembled modular electrical connector jack after receiving an insulated wire according to one embodiment of the present invention.
Figure 6:
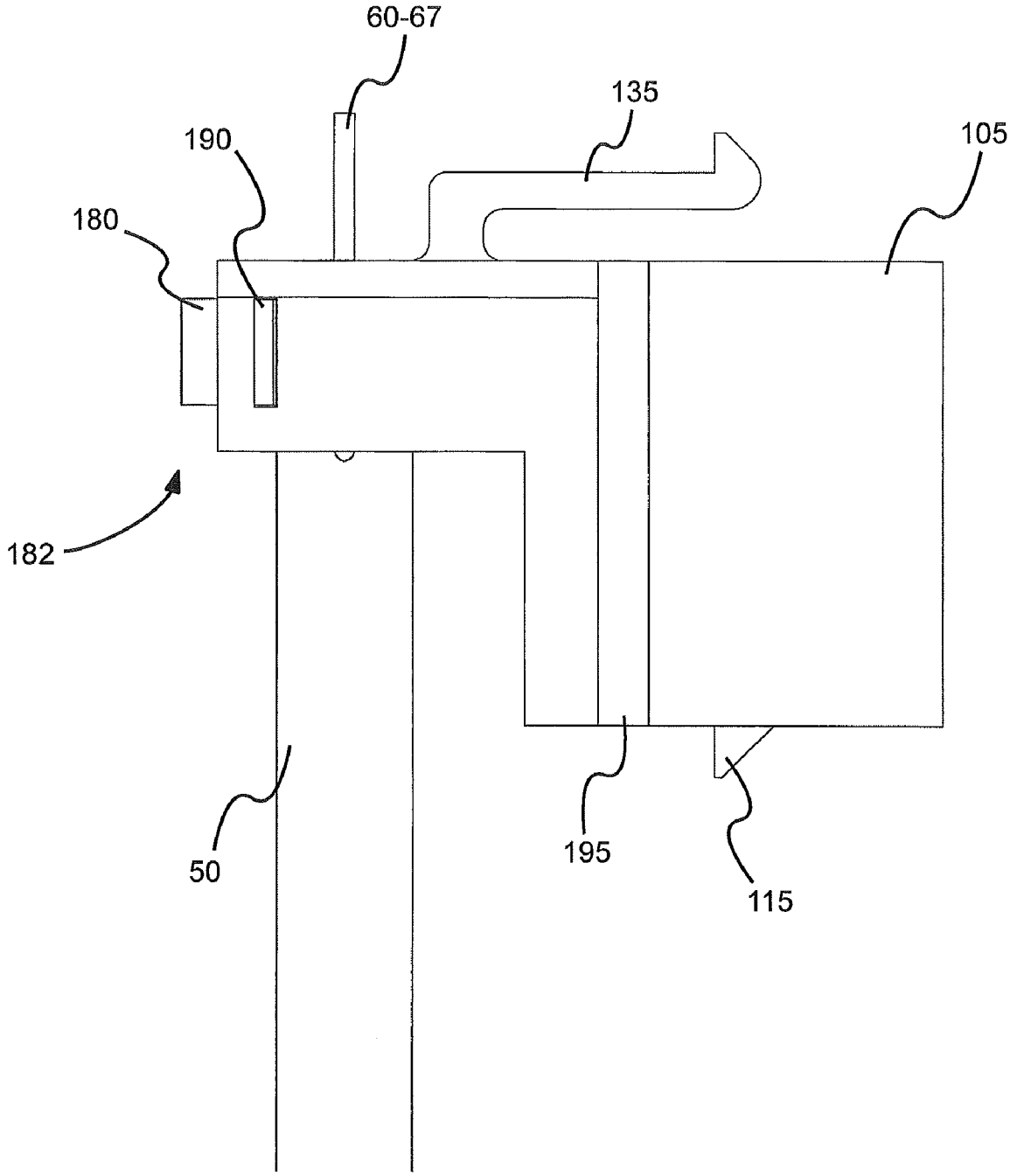
FIG. 6 shows a side view of an assembled modular electrical connector jack after receiving an insulated wire according to one embodiment of the present invention.

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. The features and advantages of the present invention are illustrated in detail in the accompanying drawings, wherein like reference numerals refer to like elements throughout the drawings.

As a preface to the detailed description, it should be noted that, as used in this specification and the appended claims, the singular forms "a," "an" and "the" include plural referents, unless the context clearly dictates otherwise.

Referring to FIGS. 1-4, an electrical connector 100 is shown, having a housing portion 105. The electrical connector 100 may be a modular jack configured according to typical registered jack communication standards. Housing portion 105 may comprise at least two separate pieces, for example a first housing portion 125 and a second housing portion 130, attachably connected to form main body 105. A multi-piece housing is clearly shown in FIGS. 2-3. Furthermore, one housing portion 125, 130 may include a mating connector 165 in order to aid in the assembly of the housing portion 105. Mating connector 165 may be designed to be inserted into the hollow of a corresponding housing portion. Housing portion 105 may be a plastic material, or any other material that would help insulate electrical wiring from the outside environment, such as rubber or any other polymer.

Housing portion 105 may further comprise a resilient latch tab 135. Resilient latch tab 135 may cooperate with fixed latch member 115 to releasably retain the electrical connector 100 in assembly with an associated apertured wall plate (not shown). Resilient latch tab 135 may be located on the top face of main body 105, and fixed latch member 115 may be on the bottom face of main body 105. Alternately, resilient latch tab 135 and fixed latch member 115 may be located on any opposing faces. It should be understood by one of ordinary skill that latching combination 135, 115 is not limited to that as shown in FIGS. 1-8, but may also be a fastener, a catch, a clasp, a clench, a grip, a hold, a lock, a press, a snap and a vice so long as electrical connector 100 is releasably retained in assembly with an associated wall plate.

Electrical connector 100 includes a plug socket 110 opening up into the housing 105. The socket 110 may be located on the front face of main body 105, and may be configured to accept a cable plug, including, but not limited to any type of registered jack (RJ) connector. For example, socket 110 may be configured to accept the plug connector of a shielded twisted pair (STP) cable, an unshielded twisted pair (UTP) cable, a screened shielded twisted pair (S/STP) cable, a fully shielded twisted pair (FTP) cable, or any variant thereof. Electrical connector 100 may therefore be any form of modular jack.

The electrical connector 100 includes at least one conductive terminal 175. Conductive terminal 175 may be housed within the housing portion 105. A further conductive terminal housing 170 may also be provided to further house and protect conductive terminal 175. Conductive terminal 175 may include a first wire contact portion 120 having one or more wire contact points 121, and a second wire contact portion 150. In operation, the first contact portion 120 and the second contact portion 150 may be located within conductive terminal housing 170. However, the first contact portion 120 and the second contact portion 150 may also be operably located outside of conductive terminal housing 170. Second contact portion 150 may be a conductive finger, configured to be electrically connected to a modular plug (not shown), whereby the conductive finger 150 may be located within socket 110.

Electrical connector 100 may further include a cavity 155. Cavity 155 may operate with a conduit 145 having first end opening 140 through the housing 105 and configured to receive at least one insulated wire 60, 61, 62, 63, 64, 65, 66, 67 (see FIG. 5-8) fed through into the conduit 145. The cavity 155 may operate with a second end 141 of the conduit 145, wherein the second end opening extends through the housing 105. The cavity 155 may be in physical communication with the first end opening 140 and the second end opening 141. The at least one received insulated wire 60-67 may be received into the conduit 145 and may pass through the cavity 155, and may be extended through the second opening 141 and out of the housing 105 (see, for example, FIGS. 5-6). When the insulated wire 60-67 extends through the second opening 141, the wire 60-67 may be pulled tight through the conduit 145 and conduit cavity 155. First feed opening 140 may be located on the first bottom face 106 of the housing 105, and the second feed opening 141 may be located on the second top face 107 of the housing 105. Alternately, wire feed conduit openings 140, 141 could be located on the left and right sides of housing 105.

First and second feed openings 140, 141 of a conduit 145 may comprise a plurality of interconnected channels, each channel configured to accept a corresponding individual insulated wire 60-67. Alternately, first and second conduit openings 140, 141 may extend with a number of individual through hole conduits 145. It will be apparent to those skilled in the art that wire feed conduits 145 may take various forms which allow an insulated wire 60-67 to be pulled through housing 105 to extend out of the housing 105. Insulated wire 60-67 may be the internal twisted wires of a STP, UTP, S/STP, or FTP cable 50, as described above. Although not limited to this position, cavity 155 may be contained within a thinner portion of the main body 105 of jack 100.

With further reference to FIGS. 1-4 and additional reference to FIGS. 5-8, insulated wires 60-67 may be pulled through the housing and tightened so that the outer insulation of twisted wire cable 50 abuts first conduit opening 140 of housing portion 105, and so that the ends of the wires 60-67 extend out of the housing 105 through the second conduit opening 141. Thus, the outer insulation of twisted wire cable 50 protects the internal insulated wires 60-67 close to where the internal insulated wires 60-67 are inserted into the housing through first feed opening 140. Furthermore, the insulated wires 60-67, as protruding through second opening 141, may be cut flush (as in FIG. 7) with the top of main body 105.

Figure 7A:
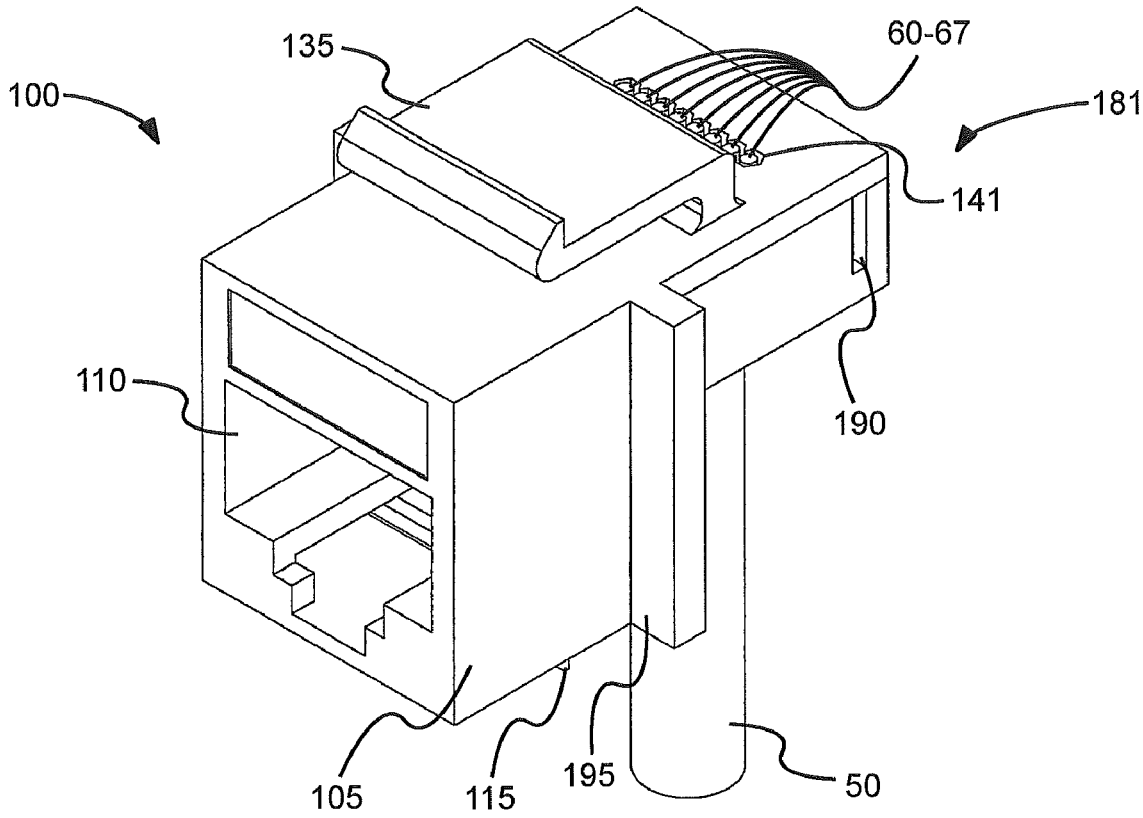
FIG. 7A shows a perspective view of an assembled modular electrical connector jack after receiving an insulated wire according to one embodiment of the present invention.
Figure 7B:
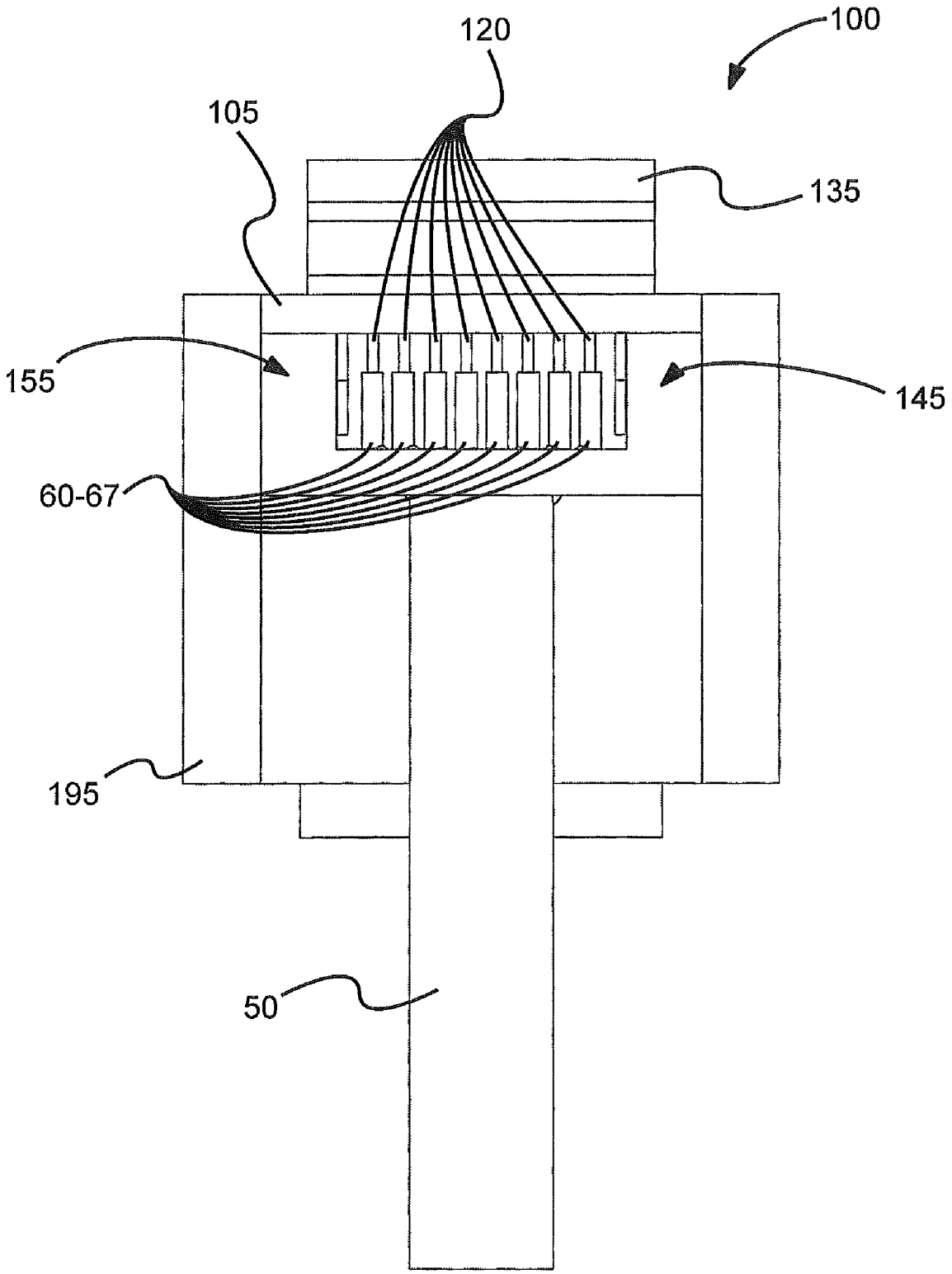
FIG. 7B shows a rear view of an assembled modular electrical connector jack after receiving an insulated wire, wherein the pressing portion has been removed to reveal a cavity according to one embodiment of the present invention.
Figure 7C:
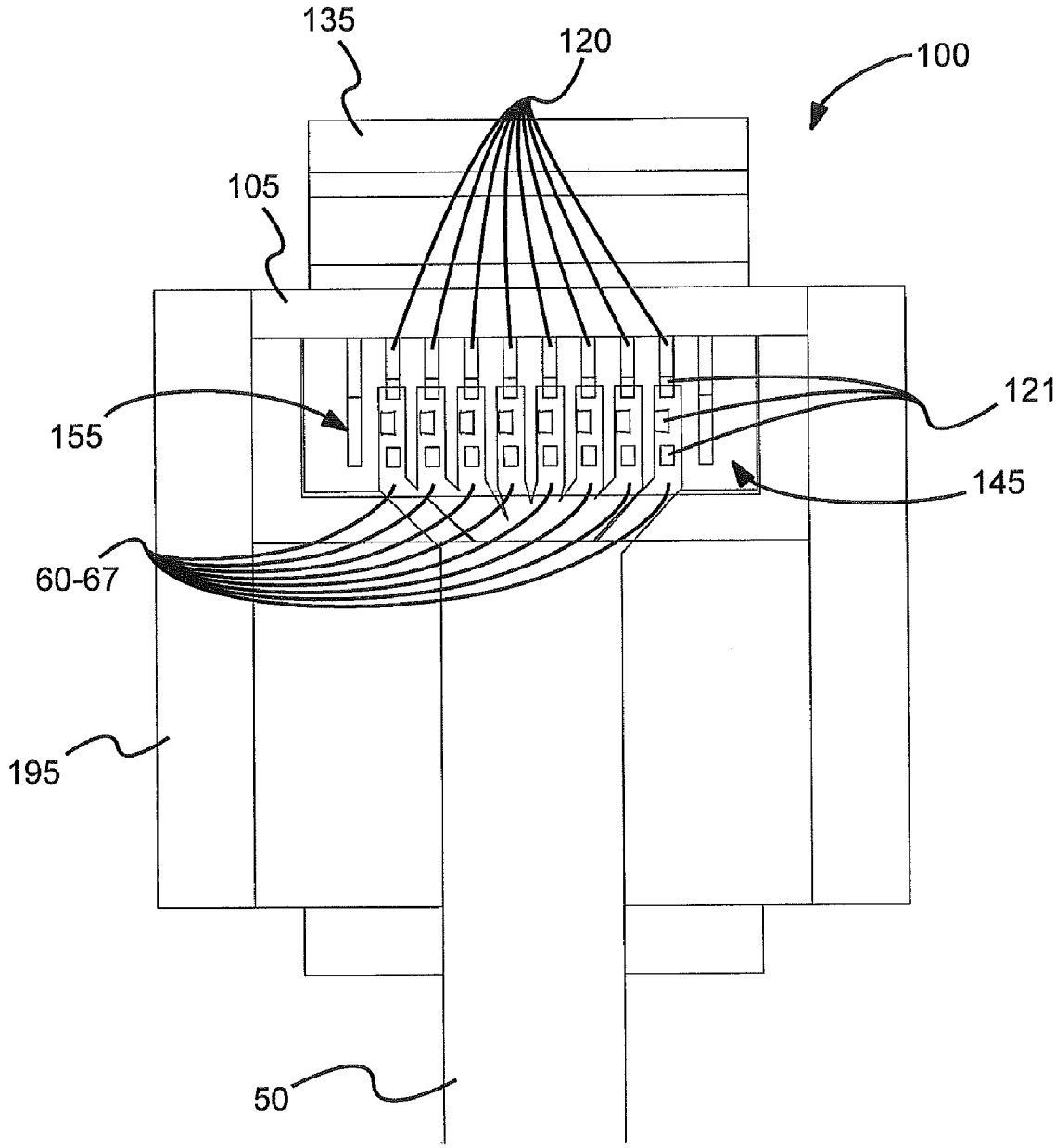
FIG. 7C shows a rear view of an assembled modular electrical connector jack after a received insulated wire begins to engage a wire contact portion according to one embodiment of the present invention.
Figure 7D:
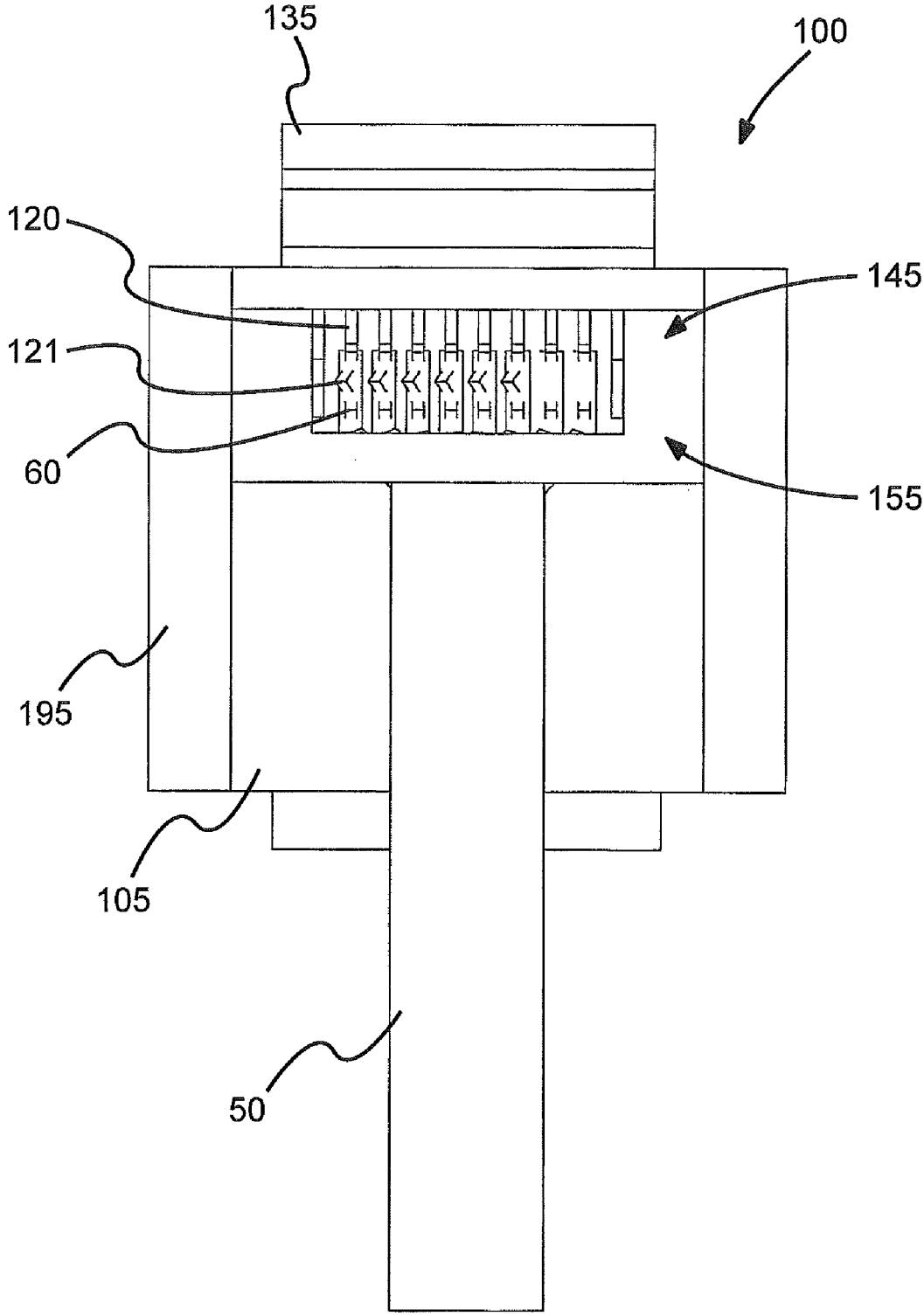
FIG. 7D shows a rear view of an assembled modular electrical connector jack after a received insulated wire is engaged by a contact point of a wire contact portion according to one embodiment of the present invention.
Figure 8:
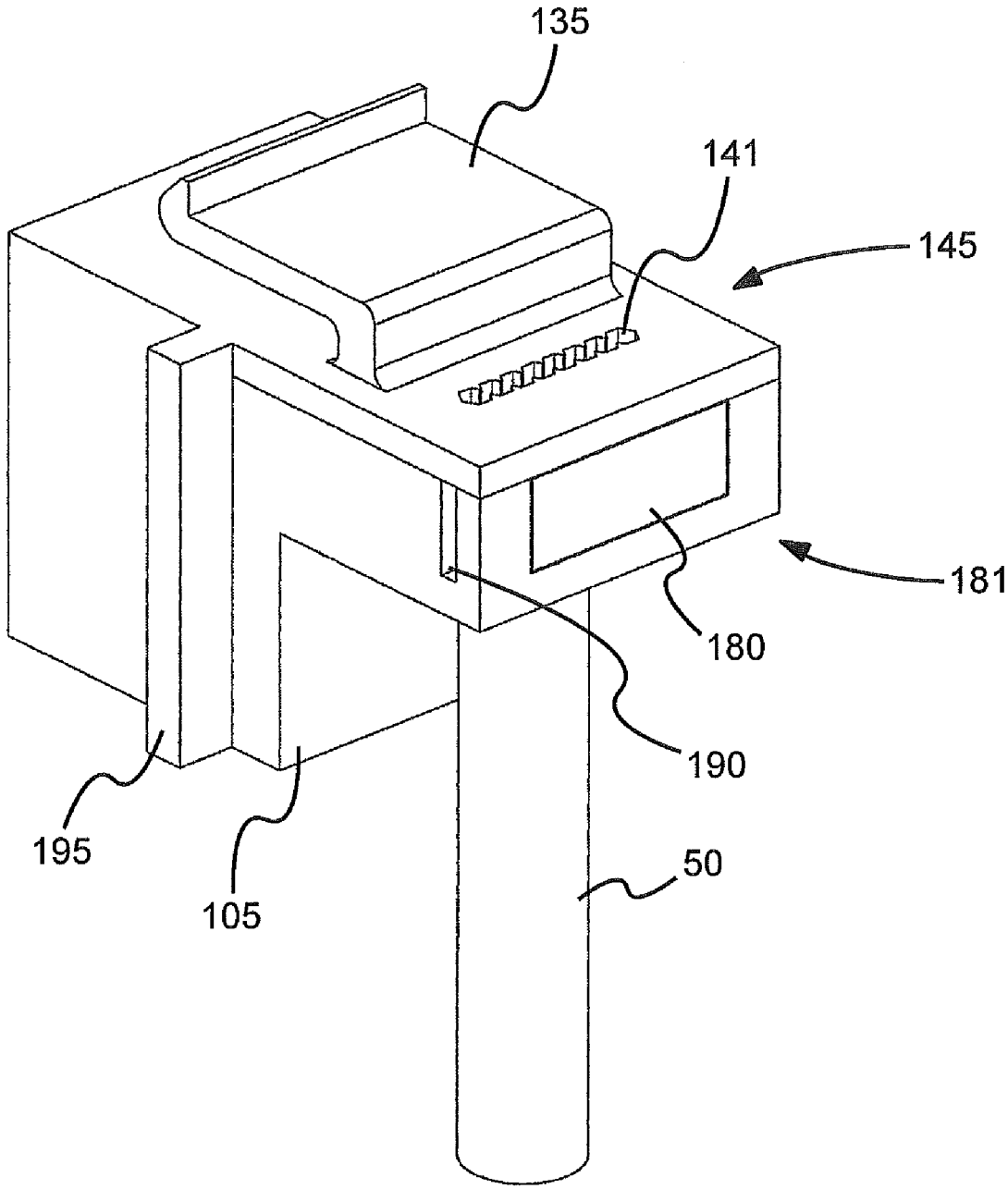
FIG. 8 shows a rear perspective view of an assembled modular electrical connector jack after receiving and engaging an insulated wire according to one embodiment of the present invention.

Moreover, as depicted in FIGS. 7B-7D, which depict a rear view of the connector having the plug 180 removed to readily view the cavity 155, the insulated wires 60-67 may be inserted through the first feed openings 140 and into association with cavity 155. The first contact portion 120 may include one or more contact points 121 that may extend within at least a portion of conduit cavity 155. The first wire contact portion 120 may be an insulated displacement contact (IDC) for connecting at least one insulated wire 60-67 to conductive terminal 175. The contact points 121 of the IDC 120 may have sharpness sufficient to pierce or slice the insulation of the wires 60-67, thereby terminating insulated wires 60-67. There may be a plurality of IDCs 120 each corresponding to at least one insulated wire 60-67. The placement of the cavity 155 and conduit 145 of the electrical connector 100 allows the contact between IDC(s) 120 and insulated wire(s) 60-67 to be very close to point at which the insulated wires 60-67 are still twisted as commonly included in a single cable 50.

The electrical connector 100 includes a pressing portion 180, such as a slug, plug member, or other insertable component, configured to be inserted into a pressing portion cavity 160. The pressing portion 180 may have a generally rectangular shape and may be made of a plastic material and may also be made of any other suitable non-conductive material. Pressing portion 180 may be inserted into pressing portion cavity 160 on the back face of the main housing body 105. The pressing portion 180 includes a first non-pressed position 182, wherein the pressing portion does not fill a substantial portion of cavity 160. The pressing portion 180 also includes a second pressed position 181, wherein the portion 180 is significantly inserted into the cavity 160. In addition, the pressing portion 180 may include a pressing portion latch tab 185 which may catch into a pressing portion locking hollow 190, in order to releasably retain pressing portion 180 in a pressed position. Thus, pressing portion 180 may be movably connected to housing portion 105. The movement of the pressing portion 180, between the first non-pressed position 182 and the second pressed position 182 may be horizontal with respect to the jack 100 and in a direction substantially parallel to the extension of socket 110 into housing 105.

When insulated wires 60-67 are pulled through the housing and tightened (as in FIGS. 5-6), so that the outer insulation of twisted cable 50 abuts first feed opening 140 through housing 110, pressing portion 180 may be inserted into pressing portion cavity 160, and pressed and held in the pressed position 181 (as in FIGS. 7A-8) by the cooperation of pressing portion latch tab 185 and pressing portion locking hollow 190. Pressing portion 180 may apply pressure to insulated wires 60-67, pushing them in the direction of IDCs 120, whereby the IDCs 120 terminate the insulated wires 60-67. FIGS. 7B-7D depict a rear view of the jack 100 with the pressing portion 180 removed to reveal the operable engagement of the wires 60-67 by the contact points 121 of the IDC's 120 within cavity 155, as the pressing portion 180 is compressed against the wires 60-67. Insulated wires 60-67 may be held in electrical connection with conductive terminal 175 by the insertion of pressing portion 180 into pressing portion cavity 160, so that the pressing portion 180 is secured into a compressed position 181, wherein the wires 60-67 are engaged by the contact points 121 of IDC's 120. Once in a compressed position 181, wherein the wires 60-67 are engaged by the first contact portion IDC 120, the cavity 155 may closely resemble a circumferential chamber for insulated wires 60-67.

It will be apparent to those skilled in the art that the means for terminating and securing the received insulated wire 60-67 in electrical connection with the first contact portion may take various forms. For example, terminating means may include a pressing portion 180, operable with a housing body 105 as described hereinabove, or an attachable pressing body 280 operable with a main housing body 230, as described herein below in relation to FIGS. 9-13. Alternately, embodiments of the electrical connector 100 may not include a separate pressing portion 180. Instead, terminating means may comprise the entire housing 105 sliding forward, compressing insulated wire 60-67 against insulation displacement contact 120 when the wires have been pulled tight through openings 140,141 of the housing 105.

Once terminated, cable 50 may remain in a vertical position, 90 degrees to jack 100, as shown in FIGS. 5-8. However, a cap or other cover element (not shown) may be supplied to physically attach to the jack 100 to help position the cable in a bent, "parallel," state, wherein the cable is horizontal to the jack 100 when it engages the jack 100, so that the cable 50 extends in parallel with the extension of socket 110 into body 105. Such a cover component may also provide an additional means of strain relief to the jacket of the cable.

Figure 9:
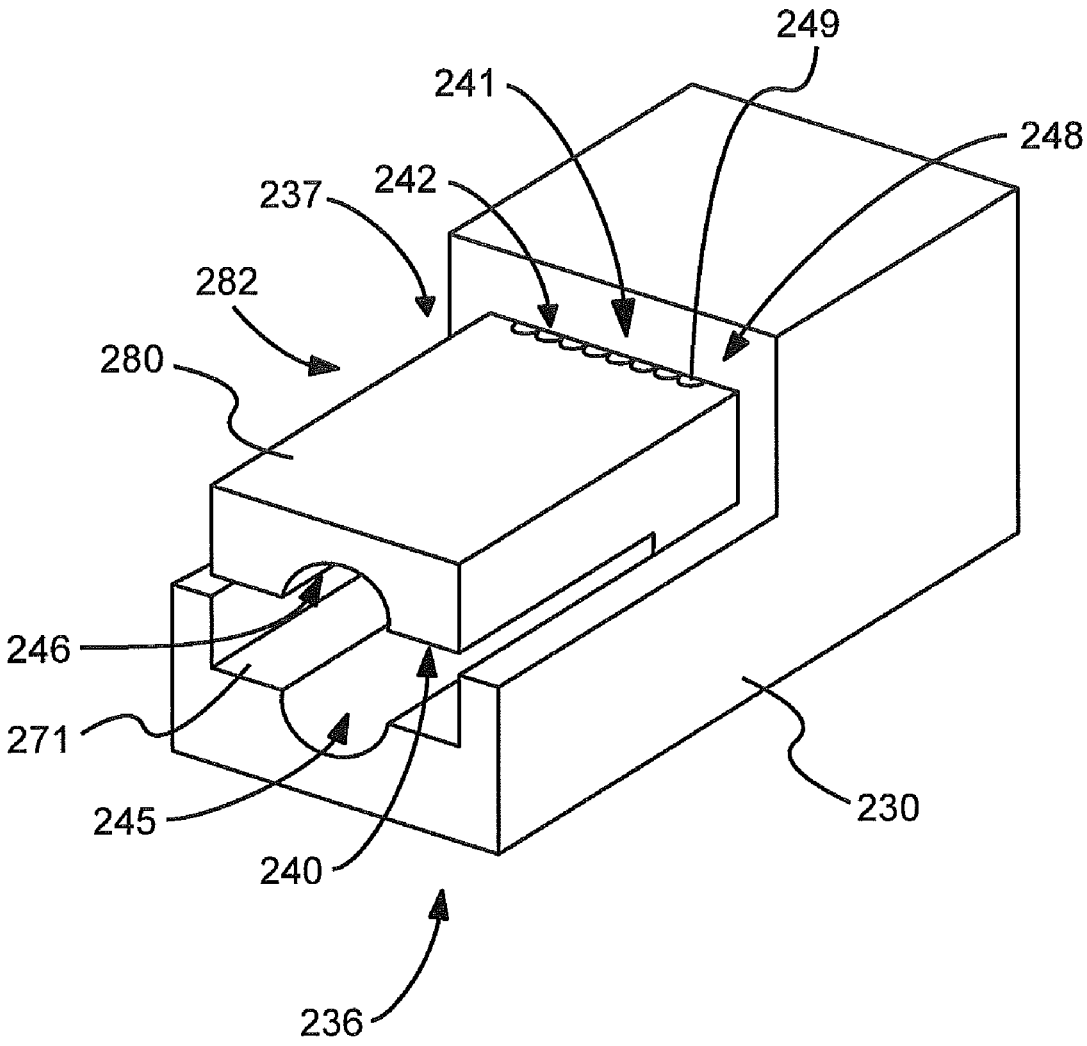
FIG. 9 shows a rear perspective view of a modular electrical connector jack according to one embodiment of the present invention.
Figure 10:
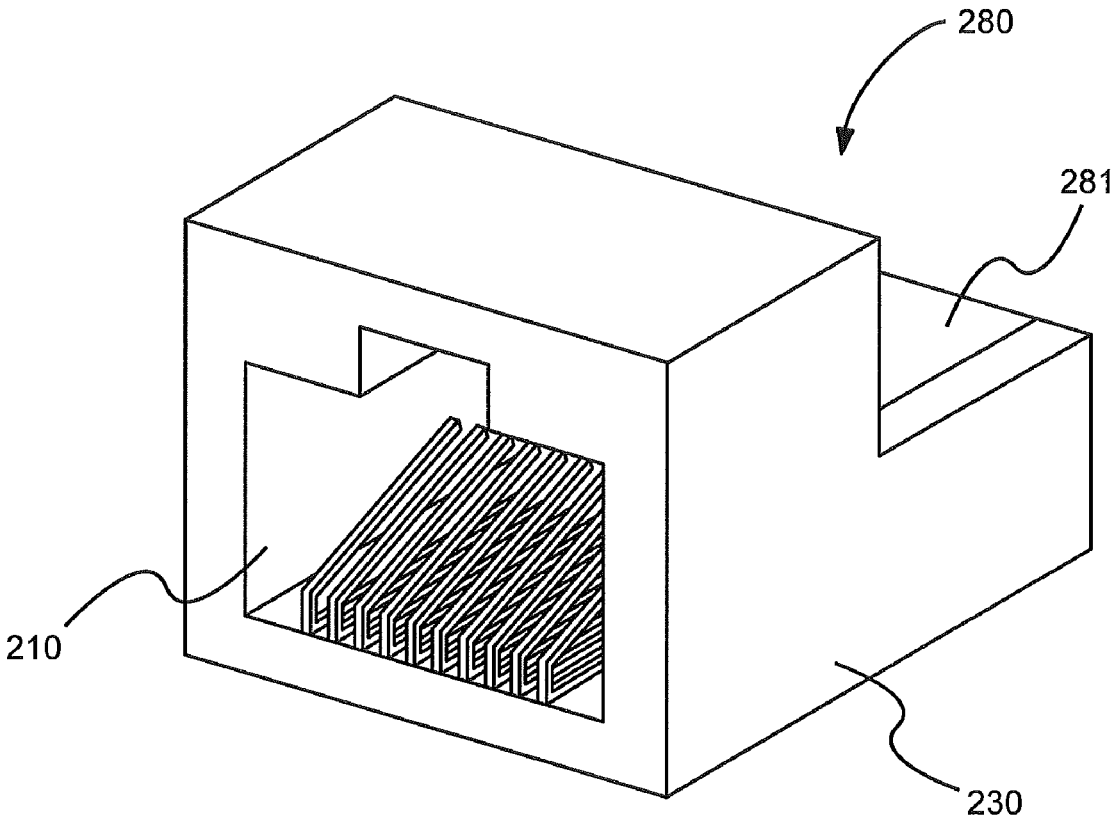
FIG. 10 shows a perspective view of a modular electrical connector jack according to one embodiment of the present invention.

FIGS. 9-10 illustrate another embodiment of the invention. An electrical connector jack 200 is shown having a main body 230. Similar to the housing portion 105 of the previous connector embodiment 100, main body 230 may comprise multiple pieces, attachably connected, in a manner similar to that described with respect to the previous embodiment 100 hereinabove. However, the main body 230 may also be formed of a single component. Main body 230 further comprises a socket 210 for receiving a plug (not shown). Main body 230 also may comprise a cooperating resilient latch tab 235 and a fixed latch member 215 to releasably retain electrical connector jack 200 in operable assembly with an apertured wall plate, as similarly described in relation to the previous embodiment 100 hereinabove.

Figure 11:
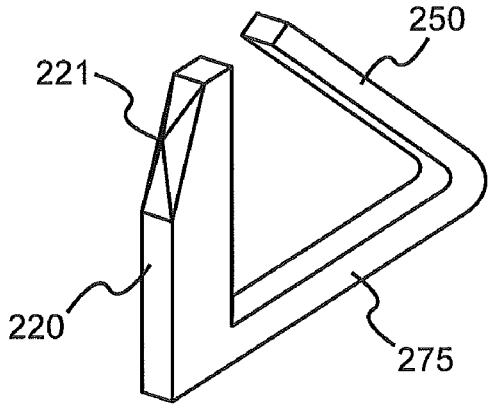
FIG. 11 shows an exploded perspective view of a conductive terminal according to one embodiment of the present invention.
Figure 12:
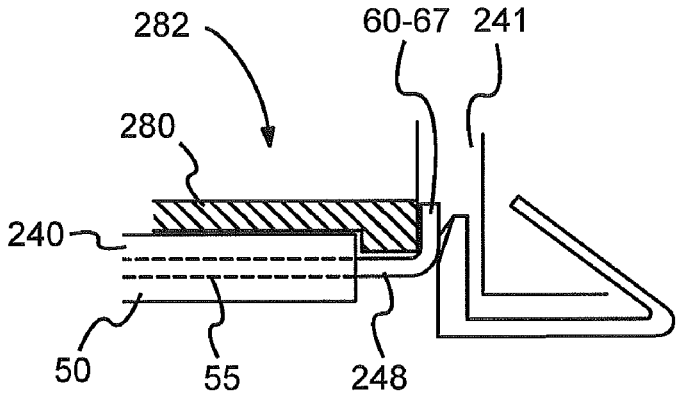
FIG. 12 shows an exploded side cutaway view of an insulated wire before termination within a modular electrical connector jack according to one embodiment of the present invention.
Figure 13:
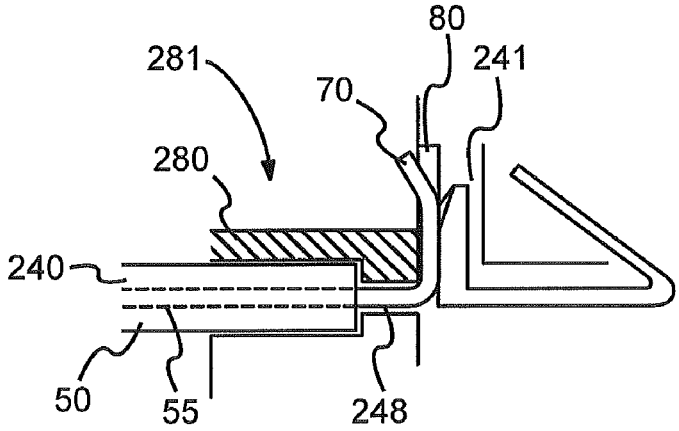
FIG. 13 shows an exploded side cutaway view of an insulated wire after termination within a modular electrical connector jack according to one embodiment of the present invention.

Electrical connector jack 200 may include a pressing body 280, such as a slug, plug member, or other insertable component, configured to be pressed into cooperation with a portion of the main body 230, to press the wires 60-67 of a cable 50 into contact with IDC's 220 (as depicted in FIGS. 11-13). Pressing body 280 may be generally rectangular in shape and may be movably attached to main body 230, on the second top face of main body 230. Main body 230 may include a first channel 245 and pressing body 280 may also contain a second channel 246. As depicted in FIG. 9, the wire pressing body portion 280 is in a first non-pressed position 282. The wire pressing body portion 280 may be moved in a direction perpendicular to the general axis of extension of the socket 210 of the connector 200. When pressing body 280 is moved to a pressed position 281, attachably connected to main body 230, channel 245 and channel 246 may combine to form a first conduit 240. Thus, when the pressing body 280 is movably connected to main body 230 in a pressed position 281, first conduit 240 is bounded by the channel 246 on the bottom of the pressing body 280 and channel 245 on the top face of the main body 230. Conduit 240 may have a circular, oval, square, or rectangular cross sectional shape, or any other shape that allows first conduit 240 to receive a STP, UTP, S/STP, FTP cable, or any variant thereof. The first conduit 240 may extend from a first back face of the main housing body 230 located opposite the socket 210 opening into the main body 230. Thus, cable 50 may be inserted conduit 240 in a direction parallel to the insertion of a typical plug into the socket 210 of the electrical connector 200.

The electrical connector 200 may also contain at least one second conduit 241 also bounded by main body 230 and pressing body 280. The second conduit 241 may run perpendicular to the first conduit 240. The second conduit 241 receives at least one conducting wire 60-67 extending from a cable 50 inserted into the first conduit 240. The wire 60-67 may be bent up and around the end of the pressing body 280 so that the cable resides in and extends through the second channel portion 249 and ultimately protrudes through a second opening 248 of the second conduit 241 on a second face 237 of the main body 230, when the pressing body 280 is pressed into attachable contact with the main body 230. Second conduit 241 may further comprise a plurality of interconnected channels, each configured to accept a corresponding individual conducting wire 60-67. Alternately, second conduit 241 may comprise at least one non-interconnected individual channel 242. In this configuration, the bounding wall of pressing body 280 may comprise grooves forming individual channel(s) 242, or the bounding wall of main body 230 may also comprise grooves forming channel(s) 242. Alternately, both the bounding wall of pressing body 280 and main body 230 may comprise the groves which together form individual channels.

Second conduit 241 may be connected to first conduit 240 and may also be on a perpendicular plane to first conduit 240. Therefore, the second conduit opening 248 through which the conducting wire 60-67 protrudes may be located on the top face of main body 230. First conduit 240 and second conduit 241 in combination may be considered a single conduit for accepting insulated wire 60-67, having a first end 247 and a second end 248.

Referring to FIG. 11, a conductive terminal 275 is shown, having a first IDC portion 220 and a second finger portion 250. Electrical connector 200 may comprise a plurality of conductive terminals 275. The finger portion 250 may become electrically connected to the plug in a manner similar to the conductive finger 150 of electrical connector 100 as described hereinabove. The IDC portion 220 includes a pointed, sharpened, or otherwise blade-like wire contact portion 221, wherein the contact portion 221 is sharp enough to pierce or slice the insulation of conducting wire 60-67. Electrical connector 200 may be configured so that the IDC wire contact portion 221 of each conductive terminal 275 is located within second conduit 241. When pressing body 280 is attached to main body 230, an insulated conducting wire 60-67 may be terminated with the wire contact portion 221 of the IDC 220, as described herein below.

FIG. 12 shows a side cutaway view of pressing body 280 prior to being attached to main body 230. As shown in FIG. 12, the pressing body is not located in a pressed position 281 and the insulated conducting wire 60-67 is not terminated or otherwise electrically coupled to wire contact portion 220. A cable 50 having an outer insulation 55 and one or more internal insulated wires 60-67 is shown following insertion within first conduit 240. An end portion of the insulation 55 of the cable 50 is stripped away and the internal insulated wires 60-67 of the cable 50 are pulled tight around and through the second conduit 241.

FIG. 13 shows a side cutaway view of pressing body 280 after termination of insulated wires 60-67 with the sharp contact portion 221 of the IDC 220 of the conductive terminal 275. By positioning the pressing body 280 in a pressed position 281, the wires 60-67 may be forced into contact with the sharp portion 221 of IDC 220. As shown, an inner conductor 80 of wire 60 comes into electrical connection with IDC 220 after the insulation 70 of the wire 60 has been cut sliced, pierced, or otherwise displaced by the IDC portion 220, and is held in electrical connection by attached pressing body 280, when in the pressed position 281. The pressing action of the pressing body 280 may allow the wire 60 to move downward, or parallel to the orientation of the IDC 220. Thus the IDC 220 may slice the outer insulation 70 of the wire 60 and make good physical and electrical contact with the inner conductor 80 of the wire 60.

Figure 14:
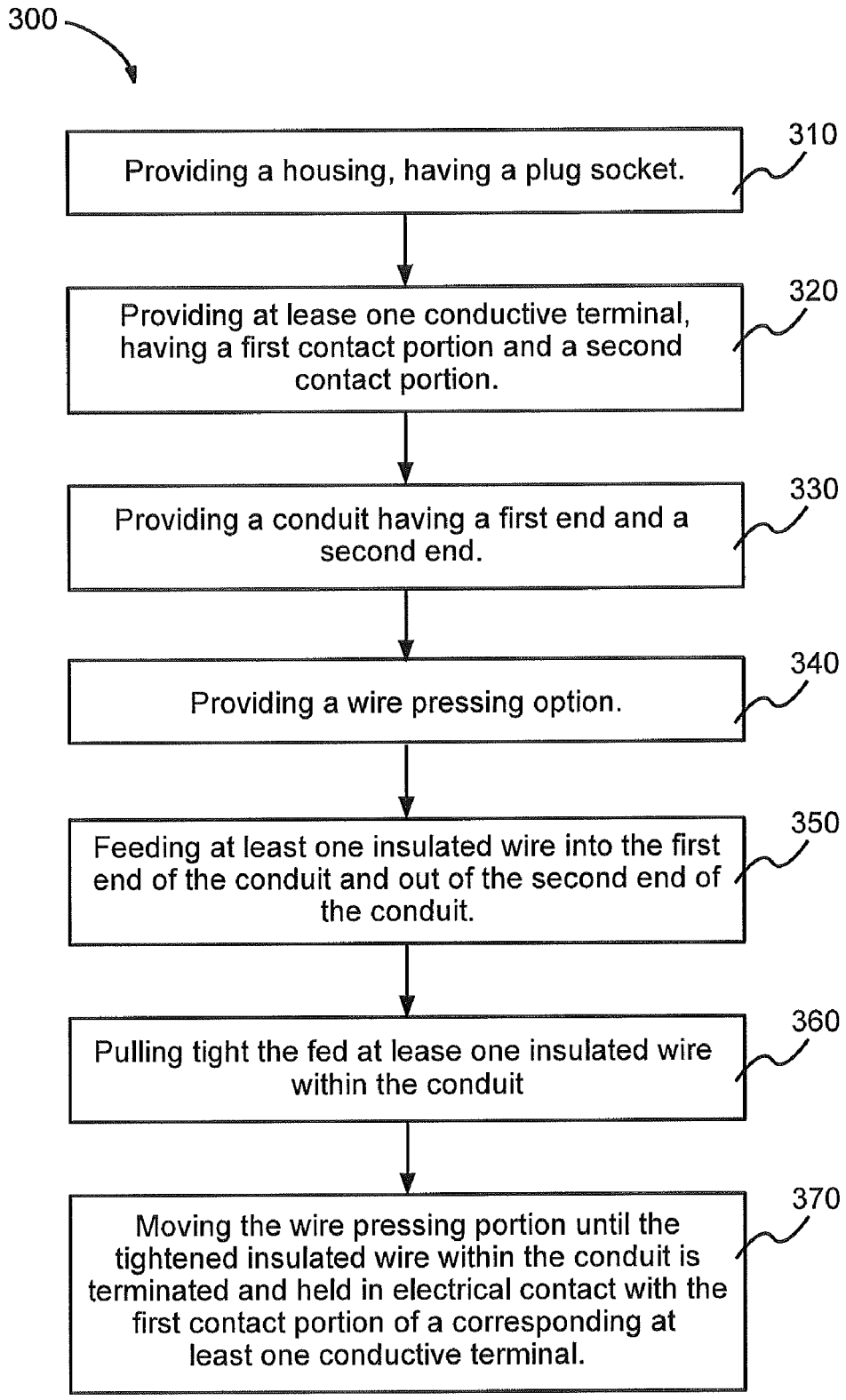
FIG. 14 shows a method for assembling an electrical connector according to one embodiment of the present invention.

Referring to FIG. 14, a method for assembling an electrical connector 300 is shown. Method 300 comprises the step 310 of providing a housing containing a socket which is configured to receive a plug. The housing and socket may be similar to those described hereinabove as housing 105, 230, and socket 110, 210, as shown in FIGS. 1-13. The plug, although not shown, may be any standard plug operable with internal twisted wires of a STP, UTP, S/STP, or FTP cable, such as cable 50. For instance, the plug may be a typical registered jack plug. Further methodology includes the step 320 of providing at least one conductive terminal within the housing, the conductive terminal having a first and second contact portion, the second contact portion configured to be electrically connected to the plug. The conductive terminal and first and second contact portions may be similar to those described hereinabove as conductive terminal 175, 275, first contact portion 120, 220 and second contact portion 150, 250, as shown in FIGS. 1-13. Additionally, the electrical connector assembly method includes a step 330 of providing a conduit having a first end and a second end, the first contact portion of the conductive terminal being in the conduit. The conduit, first end openings, and second end openings are described hereinabove as conduit 145, 240, 241, first end opening 140 and 247, and second end 141, and 248. If the conduits 240 and 241 comprise one interconnected conduit, then that conduit would have a first end opening 247 and a second end opening 248.

The method of assembling an electrical connector 300 further comprises the step 340 of providing a movable wire pressing portion. The wire pressing portion is described hereinabove as pressing portion 180, 280, as shown in FIGS. 1-13. The movement of the wire pressing portion helps to terminate wires 60-67 to conductive elements within the housing 105, 230. Moreover, the electrical connector assembly method 300 includes the step 350 of feeding at least one insulated wire 60-67 into the first end 140, 247 of the conduit 145, 240, 241 and out of the second end 141, 248 of the conduit 145, 240, 241. The wires 60-67 may be fed into channels, such as through openings 140, 141, 247. Then an additional assembly method step 360 of pulling tight the fed insulated wire within the conduit 145, 241 may be performed. This step may also include pulling the wire tight through a cavity 155. An electrical connector may further be assembled by performing a step 370 of moving the wire pressing portion until the tightened insulated wire 60-67 within the conduit 145, 241 is terminated and held in electrical contact with the first contact portion 120, 220 of a corresponding conductive terminal 175, 275.

In addition to the methodology described above, the electrical connector assembly method 300 may further comprise a step of untwisting twisted insulated wires 60-67 before feeding the wires into the conduit. This step may include orienting the twisted pairs into proper position so that they may be fed into corresponding channels of the conduit of step 350. The proper position of the wires may correspond to the type of electrical connector being assembled. For instance, assembly of a registered jack may include untwisting the wires and positioning them in the conduit for contact with conductive terminals that corresponding to a specific registered jack configuration, such as an RJ-45 configuration. Once the wires are terminated through movement of the pressing body, an additional method step may include clipping off the wires at the second end of the conduit so that they do not protrude from the housing (see, for example, FIGS. 5-8).

In one embodiment, method 300 may further comprise positioning an insulated wire 60-67 so that the wire is perpendicularly aligned with the first contact portion. In this embodiment, such as for example connector 100, the assembly method 300 may involve moving the wire pressing portion sideways terminating the insulated wire with the first contact portion of the conductive terminal. Alternately, method 300 may further comprise an positioning an insulated wire 60-67 so that it is aligned parallel with the first contact portion, such as may be operable with a connector 200. As such, the assembly method 300 may involve moving the wire pressing portion causing the wire to move downward, parallel to the orientation of the first contact portion. The first contact portion may slice the outer insulation of the wire and make physical and electrical connection with the insulated wire.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

I claim:

1. A modular jack comprising:

a housing portion, having a plug socket;

a first conduit having a first conduit opening, wherein the first conduit opening is configured to receive at least one insulated wire;

a second conduit having a second conduit opening, wherein the second conduit opening is configured to permit extension of the at least one insulated wire out of the housing after the at least one insulated wire has been extended through the first conduit opening, so that the at least one insulated wire may be pulled tightly into position within the second conduit;

at least one insulation displacement contact located between the first conduit opening and the second conduit opening, wherein the at least one insulation displacement contact is in electrical connection with a corresponding at least one conductive finger; and a pressing portion movably connected to the housing, wherein the pressing portion is configured to move to a pressed position to terminate and hold the at least one insulated wire in electrical connection with a corresponding at least one insulated displacement contact.

2. The electrical connector of claim 1, wherein the first conduit opening is located on a first face of the housing, and wherein the second conduit opening is located on a second face of the housing.

3. The electrical connector of claim 1, wherein the pressing portion is movable between a non-pressed position and the pressed position in a direction substantially parallel to the direction of extension of the socket into the housing.

4. The electrical connector of claim 1, wherein the pressing portion is movable between a non-pressed position and the pressed position in a direction substantially perpendicular to the direction of extension of the socket into the housing.

5. The electrical connector of claim 1, wherein the at least one insulated wire is perpendicularly aligned with insulation displacement contact, wherein the insulation of the wire is pierced when the pressing portion is moved to a pressed position.

6. The electrical connector of claim 1, wherein the at least one insulated wire is aligned parallel to insulation displacement contact, wherein the insulation of the wire is sliced when the pressing body is moved to a pressed position.

7. An electrical connector jack, comprising:

a main body, having a plug socket;

at least one conductive terminal within the main body, the conductive terminal having a wire contact portion and a finger portion;

a pressing body movably connected to the main body;

a first conduit bounded by the pressing body when connected to the main body, the first conduit having an opening for receiving a cable;

a second conduit connected to the first conduit, wherein the second conduit is bounded by the connected pressing body and the main body, the second conduit configured to receive at least one insulated wire, and including an end through which a received at least one inner insulated wire protrudes from the housing, wherein the wire contact portion of the at least one conductive terminal is within the second conduit; and wherein the movable pressing body terminates and holds the at least one inner insulated wire in electrical connection with the first contact portion of a corresponding at least on conductive terminal when connected to the main body in a pressed position.

8. The electrical connector jack of claim 7, wherein the first conduit further comprises a channel, configured to accept a single cable, wherein the single cable further comprises a plurality of insulated wires encompassed by an outer insulation.

9. The electrical connector jack of claim 7, wherein the second conduit further comprises a plurality of interconnected channels, each interconnected channel configured to accept a corresponding individual conducting wire.

* * * * *

UNITED STATES PATENT AND TRADEMARK OFFICE

CERTIFICATE OF CORRECTION

PATENT NO. : 8,016,608 B2
APPLICATION NO. : 12/968227
DATED : September 13, 2011
INVENTOR(S) : Jeremy Amidon It is certified that error appears in the above-identified patent and that said Letters Patent is hereby corrected as shown below:

Claim 7, Column 12, Line 4, delete "on" and insert -- one --

Signed and Sealed this
Twenty-ninth Day of November, 2011

David J. Kappos

David J. Kappos
*Director of the United States Patent and Trademark Office*